US005402622A

United States Patent [19]

Stockley, III et al.

[11] Patent Number: 5,402,622

[45] Date of Patent: Apr. 4, 1995

[54] PEELABLE BARRIER LAYER VSP PACKAGE, AND METHOD FOR MAKING SAME

[75] Inventors: Henry W. Stockley, III; Joseph E. Owensby, both of Spartanburg, S.C.

[73] Assignee: W.R. Grace & Co.-Conn., Duncan, S.C.

[21] Appl. No.: 189,528

[22] Filed: Jan. 31, 1994

[51] Int. Cl.[6] ..... B65R 7/28

[52] U.S. Cl. ..... 53/427; 53/471; 426/129; 426/396; 426/415

[58] Field of Search ..... 53/427, 412, 471, 559, 53/453, 133, 134.1; 426/129, 396, 415; 206/467, 469; 83/869, 879; 156/270, 267, 344; 493/212, 930

[56] References Cited

U.S. PATENT DOCUMENTS 3,069,273 12/1962 Wayne ..... 53/133.7
4,055,672 10/1977 Hirsch et al. ..... 426/129
4,438,850 3/1984 Kahn ..... 426/396
4,889,731 12/1989 Williams, Jr. ..... 426/129
5,069,101 12/1991 Kleemola ..... 83/869

*Primary Examiner*—John Sipos
*Assistant Examiner*—Rodney Butler
*Attorney, Agent, or Firm*—William D. Lee, Jr.; Mark B. Quatt; L. George Legg

[57] ABSTRACT

A method for packaging a product includes the steps of providing a composite film including a non-barrier layer and a peelable barrier layer; providing a bottom web having the product supported thereon; removing a strip of the non-barrier layer from an edge of the composite film so as to provide an extending portion of the barrier layer which extends beyond the non-barrier layer; and sealing the composite film over the product to the bottom web so that the non-barrier layer overwraps the product and is sealed to the bottom web wherein the extending portion of the barrier layer forms a pull tab for peeling the barrier layer from the non-barrier layer.

13 Claims, 2 Drawing Sheets

PEELABLE BARRIER LAYER VSP PACKAGE, AND METHOD FOR MAKING SAME

BACKGROUND OF THE INVENTION

This invention relates to packaging of products such as fresh red meat products and the like, and particularly relates to a vacuum skin package having a peelable barrier layer and a method for making same.

Skin packaging can be classified as a vacuum forming process for thermoformable polymeric films. The product on a supporting member serves as the mold for the thermoformable film which is formed about the product by means of differential air pressure. However, the term "vacuum skin packaging" or VSP as it is referred to hereinafter, refers not only to the fact that the thermoformable film is formed around the product by vacuum or differential air pressure but also to the fact that the product is packaged under vacuum and the space containing the product is evacuated. Thus, there is a need for the film formed around the product and for the support member to be a barrier to oxygen, air, and other gases.

In conventional skin packaging, a backing board which is porous or which is perforated so that a vacuum may be drawn directly through the backing board is employed. In vacuum skin packaging processes generally a vacuum chamber with an open top is used. The product on an impervious backing board is placed on a platform within the vacuum chamber. The top of the chamber is covered by a sheet of film which is clamped tightly against the chamber to form a vacuum tight closure. The chamber is evacuated while the film is heated to its forming and softening temperature. The platform is then raised to drive the product into the softened film and air pressure can be used above the film to force it tightly around the product. A process of this type is disclosed in French Patent No. 1,258,357 which issued to Alain G. Bresson on Mar. 6, 1961.

A variant of the process described in the Bresson patent is disclosed in French Patent No. 1,286,018 which issued on Jan. 22, 1962 to LaRoach Freres Limited. In the LaRoach Freres process, after the chamber has been evacuated and the product driven into the heat softened film, the vacuum is released and ambient air is permitted to enter the chamber so that the thermoplastic film molds more or less onto the product since there is a vacuum on the product side of the film and ambient air pressure on the other side of the film. Australian Patent No. 245,774 which issued to Colbros Proprietary Limited et al on Jul. 16, 1967 discloses a vacuum skin packaging process in which an article to be packaged is inserted within the lower half of a vacuum chamber on a backing board, a thermoplastic film is placed over the open face of the lower half of the chamber, the chamber is closed and both halves are brought to essentially the same state of vacuum, the film is heated and softened, and then atmospheric air is introduced into the upper half of the chamber so that it alone forces the thermoplastic film down around the product and against the backing board.

Another prior art version of vacuum skin packaging is disclosed in U.S. Pat. No. 3,491,504, which issued to W. E. Young et al on Jan. 27, 1970, heat softened film is physically moved down over a stationary product and, in connection with air pressure, the softened thermoplastic film is molded onto the product.

In U.S. Pat. No. RE. 30,009, which was reissued on May 29, 1979 to Richard R. Perdue et al, a thermoformable or heat softenable film sheet is drawn by differential air pressure against the concave interior surface of the upper portion of a vacuum chamber, the film is then heated by surface contact, and then, after evacuation of the chamber, air pressure is used to blow the heat softened film down over the product and against the backing board. The resulting package comprises the product positioned on the backing board which is gas impervious and the product is held there by the thermoformable film which has been formed around the product in the exact shape of the product so that it appears to be a "skin." The thermoformable film, as stated previously, is also gas impervious and usually will consist of a number of layers each of which performs a specific function. The product contact and backing member contact layer will be a sealing or heat sealable layer, an interior layer will typically be a barrier layer which comprises a vinylidene chloride copolymer (PVDC) or a hydrolyzed ethylene/vinyl-acetate copolymer (EVOH), and the outer surface layer will be an abuse layer to protect the barrier layer from scratches, pin holes, moisture attack and the like.

In U.S. Pat. No. 3,574,642which issued on Apr. 13, 1971 to Carl Frederick Weinke, a package for and a method of packaging meats is disclosed. The package includes an inner oxygen-permeable member which may be either gas flushed or evacuated. The package preserves the freshness of the meat until the meat is ready to be marketed to the consumer. For marketing, the outer wrapper is removed and the inner package is displayed at the meat counter for the consumer. Being oxygen-permeable, the inner wrapper admits oxygen to the interior of the package causing the fresh meat product to change to a bright red color which the consumer associates with freshness. The inner pouch of the Weinke package may consist of polyethylene film and the outer pouches may be cellophane film with a coating of saran (vinylidene chloride copolymer or PVDC.) Another patent showing portions of fresh meat individually packaged in oxygen permeable plastic film and inserted into an outer container of impermeable film is U.S. Pat. No. 3,681,092 which issued to Oliver R. Titchness et al on Aug. 1, 1972.

Another prior art package is described in U.S. Pat. No. 3,713,849 which issued to Paul E. Grindrod et al on Jan. 30, 1973. In the Grindrod et al patent a fresh meat package having an outer oxygen impermeable lamina which is readily and entirely peelable from an inner oxygen-permeable lamina is disclosed. The package includes means for initiating the peeling separation along an edge of the package. The outer oxygen barrier maintains meats in well preserved condition in spite of the purplish color which has low consumer appeal. Shortly prior to display for sale to the consumer the outer lamina is removed by the retailer and the product develops a healthy, bright red "bloom" due to the high rate of oxygen permeation through the inner remaining film package. The material disclosed in Grindrod et al is a laminate of PVC/Saran and EVA/Saran. (EVA designates ethylene/vinyl-acetate copolymer and PVC designates polyvinyl-chloride.) The EVA and PVC layers are the inner layers and at the periphery of the package they are sealed together but form a weak bond. The saran layers can be readily peeled from the respective EVA or PVC layers as saran does not form a strong bond between either. Gripping tabs are also provided.

Yet another peelable package is shown in U.S. Pat. No. 4,055,672 which issued on Oct. 25, 1977 to Arthur Hirsch et al. In the Hirsch et al patent a semi-rigid tray of oxygen impermeable material is formed, a meat product placed therein, and then the tray is sealed around its upper periphery or flange area by a composite lid which has an inner layer of oxygen permeable material, an adhesive layer, and an outer layer of oxygen impermeable material. When the package is ready for retail display so that oxygen can reach the fresh meat packaged within the tray, the outer impermeable lid is peeled away so that the oxygen can penetrate through the remaining oxygen permeable portion of the lid.

In order to readily open packages where plastic film layers have been sealed together to close the package, various tear tabs and easy open mechanisms have been devised. One such easy-to-open, delaminating seal is disclosed in U.S. Pat. No. 4,638,913 which issued on Jan. 27, 1987 to Milton A. Howe, Jr. In this patent, two grippable film folds are provided and the folds when pulled apart will rupture one of the outer layers of the sealed together film and delaminate the film to its edge.

The aforedescribed tear tabs and easy open mechanisms typically involve the rupturing of the non-barrier or oxygen permeable layer so that the portion of the non-barrier layer which is included in a pull tab is separated for removal while the remaining non-barrier layer remains sealed in place over the product as desired. To provide this feature, "non-stick" tabs are disposed between the non-barrier layer and the bottom web, and perforations, score lines and the like may be necessary to reduce the internal strength of the non-barrier layer so that it will rupture when and where it is desired.

It would be desirable to provide a package wherein peeling does not require rupturing of one of the layers.

It is therefore the principal object of the invention to provide a package and a method for packaging wherein a barrier layer is readily peelable without rupturing the non-barrier layer.

It is a further object of the invention to provide a package and packaging method wherein extra material for pull tabs is not needed.

It is a still further object of the invention to provide a method for making a package wherein conventional packaging equipment can be used.

Other objects and advantages will appear hereinbelow.

SUMMARY OF THE INVENTION

The foregoing objects and advantages are readily attained by the present invention. In accordance therewith, a method is provided for making a VSP package having a peelable barrier layer, comprising the steps of providing a composite film comprising a non-barrier layer and a peelable barrier layer; providing a bottom web having the product supported thereon; removing a strip of the non-barrier layer from an edge of the composite film so as to provide an extending portion of the barrier layer which extends beyond the non-barrier layer; and sealing the composite film over the product to the bottom web so that the non-barrier layer overwraps the product and is sealed to the bottom web wherein the extending portion of the barrier layer forms a pull tab for peeling the barrier layer from the non-barrier layer.

In accordance with the present invention, a package is provided which comprises a bottom wed supporting a product; a composite film having a non-barrier layer and a peelable barrier layer, the non-barrier layer enclosing the product and being sealed to the bottom web and having a cut-back portion so as to provide an extending portion of the peelable barrier layer which extends beyond the non-barrier layer, wherein the extending portion forms a pull tab for peeling the barrier layer from the non-barrier layer.

BRIEF DESCRIPTION OF THE DRAWINGS

A detailed description of preferred embodiments of the invention follows, with reference to the accompanying drawings, wherein.

DETAILED DESCRIPTION

The invention relates to a method for packaging a product, particularly fresh red meat products, in a package having a peelable gas barrier layer.

Figure 1:
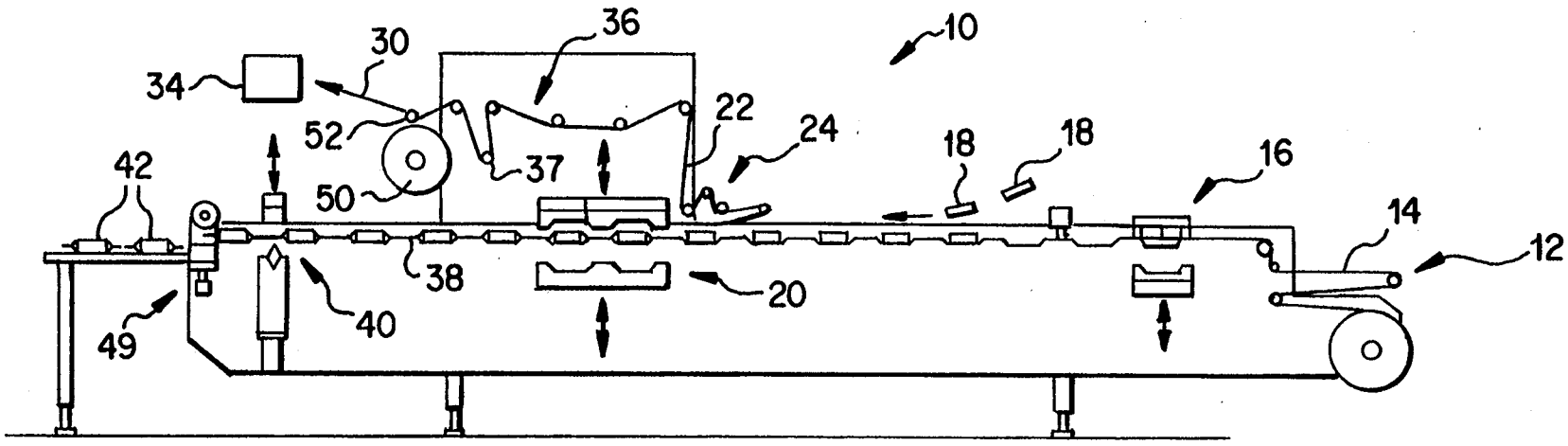
FIG. 1 is a schematic elevated view of an apparatus for performing the method of the invention.

FIG. 1 illustrates an apparatus 10 for carrying out the method of the present invention for making a package in accordance with the present invention. Apparatus 10 includes supply rollers 12 for feeding a bottom web 14 to a forming station 16 for appropriately forming bottom web 14 into a support member for the product being packaged such as a tray, a flat sheet and the like.

Products 18 are conveyed to and positioned on bottom web 14 by any suitable means known in the art, and thereafter products 18 resting on bottom web 14 are advanced toward a packaging and sealing apparatus 20.

Figure 3:
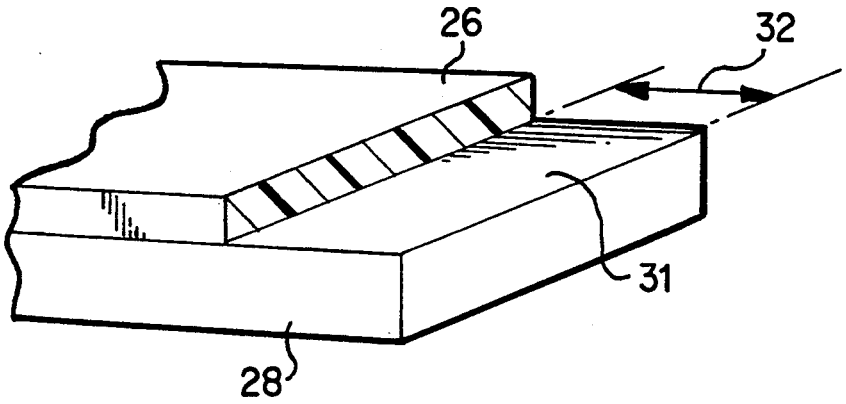
FIG. 3 is an enlarged section of a composite film in accordance with the invention.

A composite film 22 is supplied to packaging and sealing apparatus 20 by a series of rollers 24 so as to maintain tension on composite film 22. Composite film 22 includes at least a non-barrier layer 26 and a barrier layer 28 (See FIG. 3). The composite film may be made by any means known in the art such as extrusion, lamination and the like and the particular method for forming the composite film forms no part of the present invention. Packaging and sealing apparatus 20 packages product 18 between bottom web 14 and composite film 22 in conventional and well known manner so as to provide a package which is vacuum packaged for improved shelf life and which has a peelable gas barrier outer layer which, upon peeling, exposes an underlying non-barrier layer which allows oxygen to contact product 18 and oxygenate same so as to provide product 18 with a "bloomed" or bright red color which is well received by the consumer.

According to the invention, a strip 30 of non-barrier layer 26 is removed from composite film 22 prior to sealing of composite film 22 to bottom web 14. Removal of strip 30 provides an extending portion 31 of barrier layer 28 which extends beyond non-barrier layer 26. The removed strip 30 and, accordingly, the extending portion 31 preferably have a width 32 of between about 1 to about 1.5 inches. In this manner, when composite film 22 is sealed to bottom web 14, extending portion 31 forms a pull tab for peeling barrier layer 28 without using any of the aforedescribed conventional peel initiating means and without having to tear or rupture non-barrier layer 26.

In further accord with the invention, barrier layer 28 is made of a material which is sealingly incompatible with the material of the sealing surface of bottom web 14 so that, when composite film 22 is sealed to bottom web 14, sealing occurs between non-barrier layer 26 and bottom web 14 but no sealing occurs between extending portion 31 of barrier layer 28 and any corresponding section of bottom web 14 which extending portion 31 may overlap. This corresponding section of bottom web 14 and extending portion 31 of barrier layer 28, in this embodiment, provide pull tabs for separation and peeling of peelable barrier layer 28 as desired. In accordance with the invention, peeling is provided without rupturing a section of the non-barrier layer 26 as is conventionally necessary when using known pull tab and perforation configurations with peelable barrier layer packages.

Figure 2:
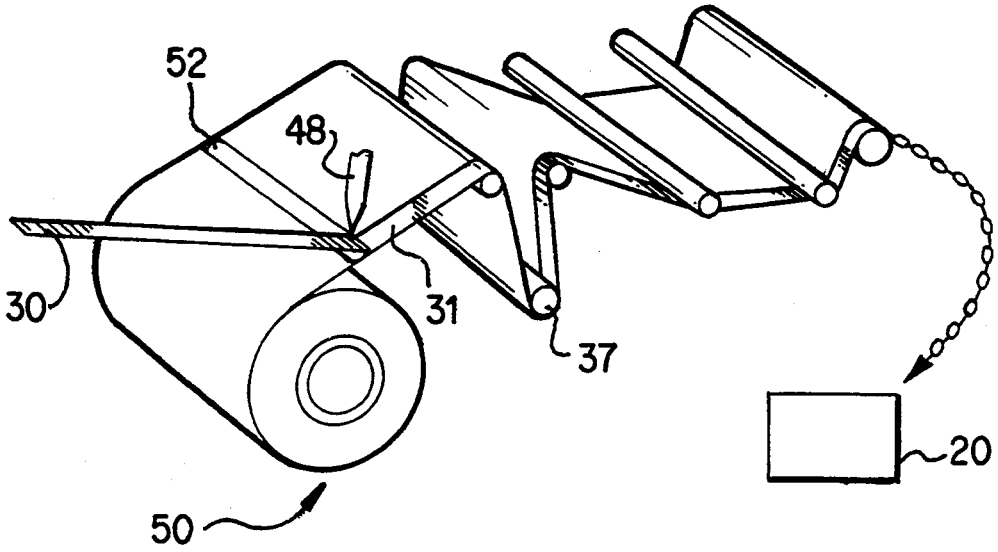
FIG. 2 is an enlarged view of a portion of the apparatus of FIG. 1.

FIG. 2 illustrates an enlarged section of apparatus 10 wherein removal of strip 30 is further illustrated. As shown, a supply of composite film 22 may be provided in roll form, with non-barrier layer 26 facing outwardly so that strip 30 can be longitudinally cut and peeled so as to provide extending portion 31 of barrier layer 28. Strip 30, as it is removed, may be wound onto a storage roller or fed to a scrap recycling station or otherwise transported to and/or disposed of at an appropriate station 34 (schematically illustrated in FIG. 1). Additional tension rollers 36 may be provided (FIGS. 1 and 2) for maintaining composite film 22 in tension as it is fed to apparatus 20. Tension rollers 36 may include, for example, dancer arm 37 for adjusting tension as required.

FIG. 2 also illustrates an embodiment of the invention for facilitating removal of strip 30. As shown, a cutting member 48 may be disposed or biased relative to film 22, for example at guide roller 52 so as to cut through non-barrier layer 26 as roll 50 rotates to feed film 22 as desired. Guide roller 52 may be provided to help ensure clean removal of strip 30, as shown. Of course, numerous other configurations could likewise be provided for removing strip 30, and cutting member 48 could be positioned in numerous locations either before or after roller 52.

Non-barrier layer 26 is made from any sufficiently oxygen permeable material which will seal to bottom web 14 and which, upon removal of barrier layer 28, will allow oxygen to pass so as to oxygenate the product. Non-barrier layer 26 preferably has an oxygen permeation rate of at least about 2000 cc per square meter per 24 hour period. Examples of suitable non-barrier materials include polyethylene film, EVA, PVC, ethylene butyl acrylate (EBA), ionomer resin such as Surlyn, and the like.

Barrier layer 28 is made from any suitable material which is sealingly incompatible with the material of the sealing surface of bottom web 14 and which is substantially impermeable to oxygen. The barrier material preferably has an oxygen permeation rate of less than or equal to about 50 cc per square meter per 24 hour period. Examples of suitable barrier material include ethylene-vinyl alcohol or hydrolyzed ethyl/vinyl acetate (EVOH), PVDC, amorphous nylon and the like.

Bottom web 14 is made from any material which is sealingly incompatible with the material of barrier layer 28. Further, bottom web may be a composite material having several layers each having different purposes. Bottom web 14 may include a layer or coating of barrier material so that the resulting package is suitably gas impermeable. The barrier layer is preferably not the sealing surface. Bottom web 14 also preferably includes a layer of a thermoformable material such as PET, PVC, polypropylene, polystyrene and the like so that bottom web 14 may be suitably formed into a tray or other form as desired. Examples of suitable materials for the sealing surface of bottom web 14 include ultra low density polyethylene (ULDPE), ethylene vinylacetate copolymers (EVA), linear low density polyethylene (LLDPE), ethylene butyl acrylate (EBA), ionomer resin such as Surlyn and the like. These materials are sealingly incompatible with EVOH and are, therefore, particularly suitable when barrier layer 28 is made of EVOH.

As shown in FIG. 1, bottom web 14 and composite film 22 are preferably supplied to sealing apparatus 20 as continuous sheets. Thus, sealing apparatus 20 provides a continuous sheet 38 of sealed packages. Sheet 38 is then fed to a cutting mechanism 40 which cuts sheet 38 into individual packages 42 each having a non-sealed strip along one edge thereof.

Figure 4A:
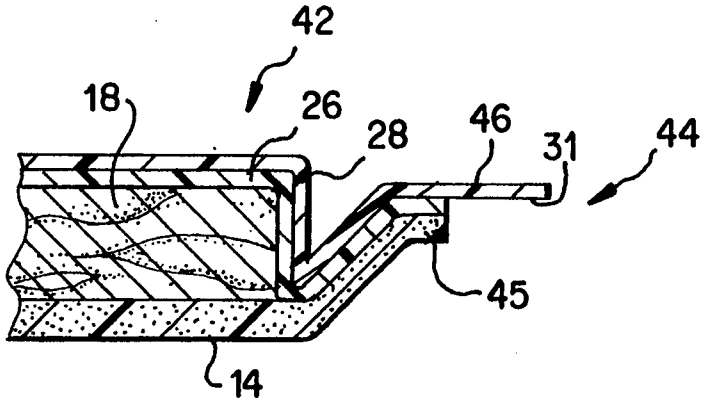
FIG. 4*a* is a similar view to FIG. 4 showing an alternate embodiment of the invention.
Figure 4:
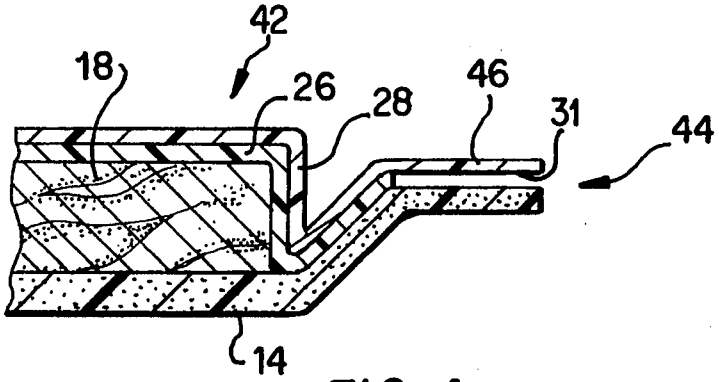
FIG. 4 is a sectional view of a portion of a package according to the invention.

FIG. 4 further illustrates an edge 44 of a package 42 according to the invention having an unsealed strip 46 for ease of peeling of barrier layer 28 in accordance with the invention. As shown, bottom web 14 has been formed into a tray and supports product 18. Composite film 22 encloses product 18 and is sealed to bottom web 14 except for the edge portion 44 where non-barrier layer 26 has been stripped away to provide extending portion 31 of barrier layer 28. Extending portion 31 is provided from material which does not seal to bottom web 14 if the two materials contact during the sealing step. Thus, a pull tab or tabs are provided wherein peeling of barrier layer 28 does not require a tearing through or rupture of non-barrier layer 26, and separation and peeling is achieved in an easier manner and with greater consistency.

In further accord with the invention, packages 42 are preferably evacuated or flushed with a low oxygen gas at any convenient time prior to completion of the sealing step so as to provide enhanced shelf life.

According to an alternate embodiment (FIG. 4*a*), extending portion 31 extends beyond a portion of bottom web 14 to further facilitate peeling of barrier layer 28. This may be accomplished by forming bottom web 14 into trays which have a narrower dimension then composite film 22. Alternatively, packages 42 may be passed to an additional station 49 for clipping a portion of bottom web 14 such as a corner or an entire edge coinciding with edge 44 so as to further facilitate separation of peelable barrier layer 28 from package 42. FIG. 4*a* shows bottom web 14 having a cut back portion 45 aligned with extending portion 31.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for packaging a product, comprising the steps of:

providing a composite film comprising a non-barrier layer and a barrier layer;

providing a bottom web having the product supported thereon;

removing a strip of the non-barrier layer from an edge of the composite film so as to provide an extending portion of the barrier layer which extends beyond the non-barrier layer; and sealing the composite film over the product to the bottom web so that the non-barrier layer overwraps the product and is sealed to the bottom web wherein the extending portion of the barrier layer forms a pull tab for peeling the barrier layer from the non-barrier layer.

2. A method according to claim 1, further including forming the bottom web of a first material and forming the barrier layer of a second material which is sealingly incompatible with the first material, whereby the extending portion of the barrier layer and the bottom web do not seal during the sealing step.

3. A method according to claim 2, wherein the first material is selected from the group consisting of ULDPE, EVA, LLDPE, EBA, and ionomer resin and the second material is selected from the group consisting of EVOH, PVDC and amorphous nylon.

4. A method according to claim 1, further including providing the composite film in roll form with the non-barrier layer arranged on an outer surface thereof.

5. A method according to claim 4, further including the steps of:

unrolling the composite film from the roll and advancing the composite film toward sealing means for sealing the film to the bottom web so as to enclose the product; and longitudinally cutting a strip of the non-barrier layer from the film so as to provide the extending portion of the barrier layer.

6. A method according to claim 5, further including passing the strip of the non-barrier layer to means for collecting scrap material.

7. A method according to claim 6, further including passing the composite film through tension roller means for maintaining the composite film in tension as it is passed to the sealing means.

8. A method according to claim 1, wherein the step of removing the strip of the non-barrier layer includes removing a strip having a width of between about 1 to about 1.5 inches.

9. A method according to claim 1, further including providing a barrier foam tray for supporting the product.

10. A method according to claim 1, further including the steps of:

providing the composite film and the bottom web as continuous sheets wherein the bottom web continuous sheet supports a plurality of spaced products;

sealing the composite film continuous sheet to the bottom web continuous sheet over the products to provide a continuous sheet of packaged products; and cutting the continuous sheet of packaged products into individual packages whereby each package has an extending portion of the barrier layer along an edge thereof.

11. A method according to claim 1, further including providing the bottom web having a cut back portion corresponding to the extending portion of the barrier layer whereby an extending peeling tab is provided for peeling the barrier layer from the non-barrier layer.

12. A method according to claim 11, wherein the cut back portion is provided by cutting away a corner of the bottom web.

13. A method according to claim 11, wherein the cut back portion is provided by cutting away an edge of the bottom web corresponding to the extending portion of the barrier layer.

* * * * *